US005873266A

United States Patent [19]

Kosugi et al.

[11] Patent Number: 5,873,266

[45] Date of Patent: Feb. 23, 1999

[54] METHOD OF KNITTING TUBULAR FABRIC HAVING 2×1 RIB STITCH

[75] Inventors: Haruo Kosugi; Masao Okuno, both of Wakayama, Japan

[73] Assignee: Shima Seiki Manufacturing Ltd., Wakayama, Japan

[21] Appl. No.: 958,586

[22] Filed: Oct. 28, 1997

[30] Foreign Application Priority Data

Oct. 29, 1996 [JP] Japan ..... 8-286266

[51] Int. Cl.[6] ..... D04B 7/10

[52] U.S. Cl. ..... 66/64; 66/60 R; 66/200; 66/172 R

[58] Field of Search ..... 66/64, 60 R, 200, 66/172 R

[56] References Cited

U.S. PATENT DOCUMENTS 3,685,316 8/1972 Robinson et al. ..... 66/64
5,211,035 5/1993 Hanson, II ..... 66/187
5,379,613 1/1995 Suzuki ..... 66/172 R
5,456,096 10/1995 Mitsumoto et al. ..... 66/172 R

*Primary Examiner*—Andy Falik
*Attorney, Agent, or Firm*—Nikaido Marmelstein Murray & Oram, LLP

[57] ABSTRACT

A method and apparatus for knitting a seamless tubular fabric of 2×1 rib stitch uses a flat knitting machine having at least one front needle bed and at least one back needle bed. The beds extend sideways and abut against each other in a front-back relationship with a trick gap between them. The needles are preferably arranged in units consisting of six needles on the front needle bed and six needles on the back needle bed. The first and sixth needle on both the front and back beds are used to form face stitches. The second and forth needles of one needle bed and the third and fifth needles of the other bed are used to form back stitches. The remaining needles are used to align the stitches. At least one of the needle beds is preferably capable of racking sideways and transferring stitches between the needle beds. The resulting tubular fabric is especially suited for rib hem parts and similar fabric components.

3 Claims, 9 Drawing Sheets

METHOD OF KNITTING TUBULAR FABRIC HAVING 2×1 RIB STITCH

FIELD OF THE INVENTION

The present invention relates to a method of knitting a tubular fabric of 2×1 rib stitch, wherein a front fabric and a back fabric are linked with each other at both side ends thereof, on a flat knitting machine having needle beds arranged in the front and in the back with a trick gap between them.

PRIOR ART

Recently, increasing attention has been given to a method of producing a sweater on a flat knitting machine, wherein the body and sleeves are knitted in tubular forms and these parts are integrated during the course of knitting to produce a sweater that is substantially completed when it is removed from the knitting machine. Front parts of sleeves, body, etc. of a sweater are held on a front needle bed of a flat knitting machine, and back parts thereof are held on a back needle bed of the knitting machine, and an approximately tubular fabric in which both ends of the respective parts are joined is knitted. Fabrics produced by the above-mentioned method require no sewing processes, and even if they require sewing, sewing processes are minimal. Thus inconvenience of sewing work is reduced. Moreover, as sewing on a machine is not required, a good elastic property that is a merit of knitted fabrics is not impaired. The application of this production method is not limited to sweaters. It is applicable to various kinds of knitted garment. These products are generally called seamlessly knitted garments, and the present applicant has been making many proposals for making such garments in, for example, Japanese Patent Publication Hei 3-75656, Japanese Patent Publication Hei 3-16413, Japanese Patent Publication Hei 4-15301 and Japanese Unexamined Patent Hei 4-153346.

Methods of knitting a rib stitch part in tubular fabrics, that are related to the main theme of the present invention, have been disclosed in the above-mentioned Japanese Patent Publication Hei 3-75656 and Japanese Patent Publication Hei 3-16413. Japanese Patent Publication Hei 3-75656 discloses the basic technique for knitting a rib stitch part in a tubular fabric on a flat knitting machine with two needle beds; this patent made it possible to produce seamlessly knitted garments on a flat knitting machine with two needle beds. Japanese Patent Publication Hei 3-16413 discloses a technique for improving the elastic property of the bottom part of 1×1 rib stitch.

Just like the 1×1 rib stitch mentioned above, the 2×1 rib stitch is a knitting method that is frequently used for the bottom of the body and the lower sleeve edges that require a good elastic property. However, no method has been disclosed that allows knitting a tubular fabric of the 2×1 rib stitch which is used for rib hem parts, etc.

SUMMARY OF THE INVENTION

To solve the above-mentioned problem, the objective of the present invention is to provide a method of knitting a tubular fabric having a portion of the 2×1 rib stitch that is used for rib hem parts, etc., on a flat knitting machine having needle beds in the front and in the back.

According to the present invention, a flat knitting machine having at least a front needle bed and a back needle bed is used, said beds, one in the front and one in the back, extending sidewise and abutting against each other, each of said beds having a large number of needles, said front needle bed and back needle bed forming a trick gap between them, and at least one of said needle beds being capable of racking sidewise, and stitches can be transferred between said needle beds. A tubular fabric is knitted, of which first fabric is made to belong to a first needle bed, and of which second fabric is made to belong to a second needle bed, and the first fabric and the second fabric are arranged in a front-back relationship and joined at side ends of the knitting width thereof.

A group of 12 needles comprising the first needle through the sixth needle of the first needle bed and the first needle through the sixth needle of the second needle bed abutting against each other is assigned as a unit of 2×1 rib stitch of the tubular fabric.

Of each unit, the first and sixth needles of the first needle bed are assigned as needles for forming face stitches of the first fabric, the first and sixth needles of the second needle bed are assigned as needles for forming face stitches of the second fabric, the second and fourth needles of the second needle bed are assigned as needles for forming back stitches of the first fabric, the third and fifth needles of the first needle bed are assigned as needles for forming back stitches of the second fabric, and other needles are assigned as empty needles for alignment of stitches.

Such units are repeatedly deployed on the needles of a range of the needle beds, and A) a step to knit a 2×1 rib stitch part in the second fabric, wherein stitches held on the second and fourth needles of the second needle bed of each of the above-mentioned units are transferred onto empty needles of the first needle bed, and stitches held on empty needles of the second needle bed are transferred onto the third and fifth needles of the first needle bed, and after that, the first and sixth needles of the second needle bed and the third and fifth needles of the first needle bed are fed with yarn to knit the second fabric, B) a step to knit a 2×1 rib stitch course in the first fabric, wherein stitches held on the third and fifth needles of the first needle bed of each of the above-mentioned units are transferred onto empty needles of the second needle bed, and stitches held on empty needles of the first needle bed are transferred onto the second and fourth needles of the second needle bed, and after that, the first and sixth needles of the first needle bed and the second and fourth needles of the second needle bed are fed with yarn to knit the first fabric, the steps A) and B) are repeated to knit a tubular fabric of 2×1 rib stitch structure.

Preferably, after repeating the above steps A) and B), of each unit, the stitch held by the first needle of the first needle bed and the stitch held by the second needle of the second needle bed are overlapped with each other on the second needle of the first needle bed or the second needle bed, and the stitch held on the sixth needle of the second needle bed and the stitch held on the fifth needle of the first needle bed are overlapped with each other on the fifth needle of the first needle bed or the second needle bed.

According to the present invention, a group of 12 needles comprising the first needle through the sixth needle of the above-mentioned first needle bed and the second needle through the seventh needle of the above-mentioned second needle bed, these sets of needles shifting by one needle from each other, is assigned as a unit for knitting a 2×1 rib stitch part in the tubular fabric.

Of each unit, the second and fourth needles (or the first and third needles) of the first needle bed are assigned as needles for forming face stitches of the first fabric, the fifth and seventh needles (or the fourth and sixth needles) of the second needle bed are assigned as needles for forming back stitches of the first fabric, the first and third needles (or the second and fourth needles) of the first needle bed are assigned as needles for forming back stitches of the second fabric, the fourth and sixth needles (or the fifth and seventh needles) of the second needle bed are assigned as needles for forming face stitches of the second fabric, and the fifth needle (or the fourth needle) of the first needle bed is assigned as the empty needle for alignment of the back stitch of the first fabric that is formed on the fifth needle (or the fourth needle) of the second needle bed, the sixth needle (or the fifth needle) of the first needle bed is assigned as the empty needle for alignment of the back stitch of the first fabric that is formed on the seventh (or the sixth needle) of the second needle bed, the second needle (or the third needle) of the second needle bed is assigned as the empty needle for alignment of the back stitch of the second fabric that is formed on the first needle (or the third needle) of the first needle bed, and the third needle (or the fourth needle) of the second needle bed is assigned as the empty needle for alignment of the back stitch of the second fabric that is formed on the third needle (or the fourth needle) of the first needle bed.

Such units are repeatedly deployed on the needles of a range of the needle beds, and A) a step to knit a 2×1 rib stitch course in the second fabric, wherein back stitches of the first fabric held on the needles of the second needle bed of each of the above-mentioned units are transferred onto empty needles of the first needle bed, and back stitches of the second fabric held on empty needles of the second needle bed are transferred onto needles of the first needle bed, and after that, needles holding the second fabric of the first needle bed and of the second needle bed are fed with yarn to knit the second fabric, B) a step to knit a 2×1 rib stitch course in the first fabric, wherein back stitches of the second fabric held on the needles of the first needle bed of each of the above-mentioned units are transferred onto empty needles of the second needle bed, and back stitches of the first fabric held on empty needles of the first needle bed are transferred onto needles of the second needle bed, and after that, the needles of the first needle bed and of the second needle bed holding the first fabric arc fed with yarn to knit the first fabric, the above steps A) and B) are repeated to knit a tubular fabric of 2×1 rib stitch structure.

EMBODIMENTS

With reference to the attached drawings, the knitting method according to the present invention will be described in detail by taking appropriate embodiments wherein the knitting method is applied to the bottom part of the body of a sweater that is to be knitted in the form of a tubular fabric.

A tubular fabric in the context of the present specification is not limited to a completely tubular fabric such as one described in an embodiment later, wherein both ends of the front and back fabrics are joined together. It includes a body wherein one of two ends of the front body and the back body is open and a fabric, such as cardigan sweater, wherein the fabric is open at the center of the front body. The flat knitting machine to be used for knitting has a front needle bed and a back needle bed, both beds extending sidewise and abutting against each other in a front-back relationship with a trick gap between them, each of said needle beds having a large number of needles, and stitches can be transferred between the needle beds, and the back needle bed can be racked sidewise.

Embodiment 1

Figure 1:
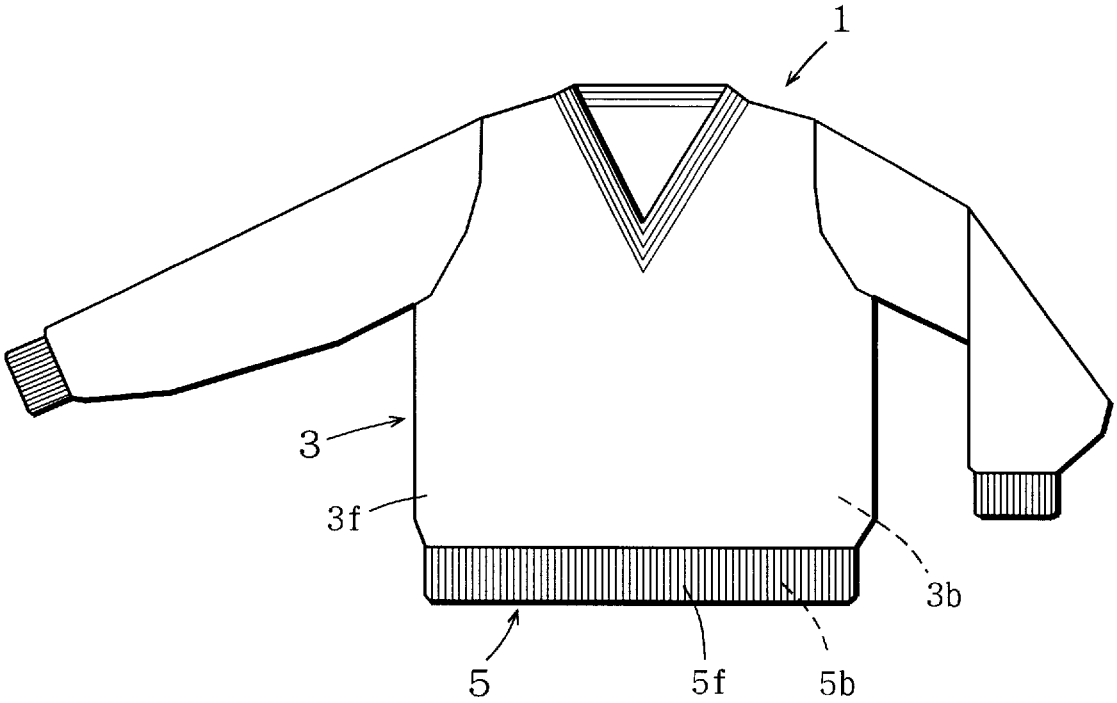
FIG. 1 shows a seamlessly knitted sweater.
Figure 2:
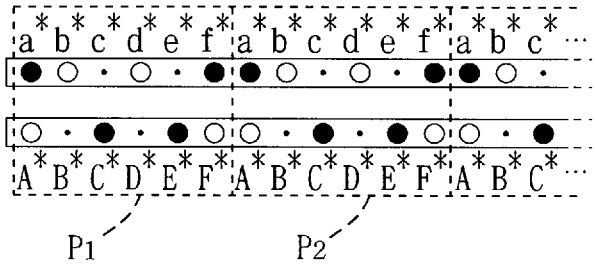
FIG. 2 shows the units of 2×1 rib stitch of Embodiment 1 of the present invention deployed on needle beds.

FIG. 1 shows a seamlessly knitted sweater 1. P in FIG. 2 indicates a unit or basic set of needles for knitting rib hem part 5 of the sweater of 2×1 rib stitch structure. The unit P comprises a total of 12 needles; the needles A* through F* of the front needle bed (the first needle bed) and the needles a* through f* of the back needle bed (the second needle bed). The 2×1 rib stitch of the front rib hem part 5*f* is formed by using the first needle A* of the front needle bed, the second and fourth needles b* and d* of the back needle bed, and the sixth needle F* of the front needle bed. The back rib hem part 5*b* is formed by using the first needle a* of the back needle bed, the third and fifth needles C* and E* of the front needle bed, and the sixth needle f* of the back needle bed. The second and fourth needles B* and D* of the front needle bed are empty needles for alignment of back stitches of the front rib hem part formed on the needles b* and d* of the back needle bed. During knitting of the 2×1 rib stitch courses of the back body 3*b*, back stitches of the front body 3*f* are held on these needles. Similarly, the third and fifth needles c* and e* of the back needle bed are empty needles for alignment of back stitches of the back body 3*b* formed on the needles C* and E* of the front needle bed. During knitting of the 2×1 rib stitch courses of the front body 3*f*, back stitches of the back body 3*b* are held on these needles. The unit P comprising just as described above is repeatedly assigned, in an appropriate number, to the needles of the respective needle beds, as P1, P2 . . . to knit a tubular fabric of a desired knitting width as shown in FIG. 2. In the present embodiment, the above-mentioned unit P is deployed on the needles A through R of the front needle bed and the needles a through r of the back needle bed to knit the rib hem parts. Capital letters of alphabet indicate needles of the front needle bed, and small letters indicate needles of the back needle bed.

Figure 3:
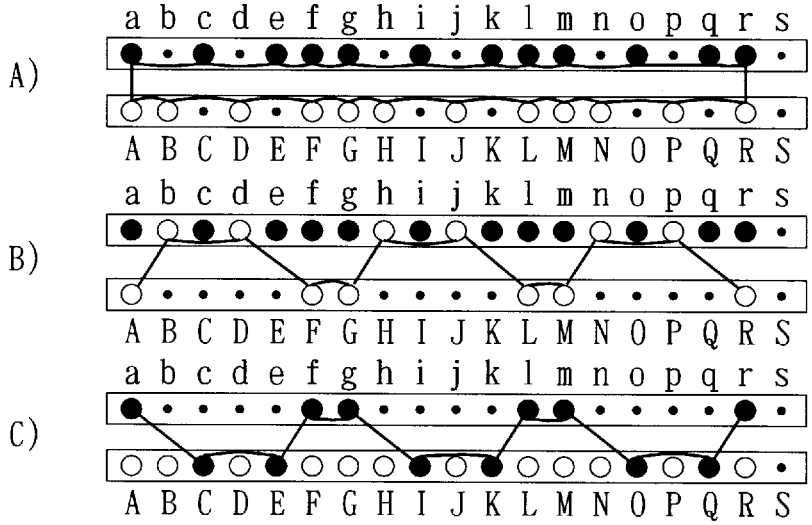
FIGS. 3(A)–(C) show how the stitches of the respective rib hem parts of the front body and the back body are held on needle beds in Embodiment 1.

FIG. 3 shows the state of knitting wherein the front rib hem part (the first fabric) is made to belong to the needles of the front needle bed, and the back rib hem part (the second fabric) is made to belong to the needles of the back needle bed. FIG. 3-A shows the stitches of 2×1 rib stitch of the bottom of the front body 3*f* held on needles of the front needle bed and the stitches of 2×1 rib stitch of the bottom of the back body 3*b* held on needles of the back needle bed; those expressed by white circles are stitches of the first fabric, and those expressed by black circles are stitches of the second fabric. The word belong" in this context means that when a stitch course of the front body 3*f* is knitted, the stitches of the back body 3*b* are made to be held on needles of the back needle bed, as shown in FIG. 3-B, and similarly, when a stitch course of the back body 3*b* is knitted, the stitches of the front body 3*f* are made to be held on needles of the front needle bed as shown in FIG. 3-C.

Figure 4:
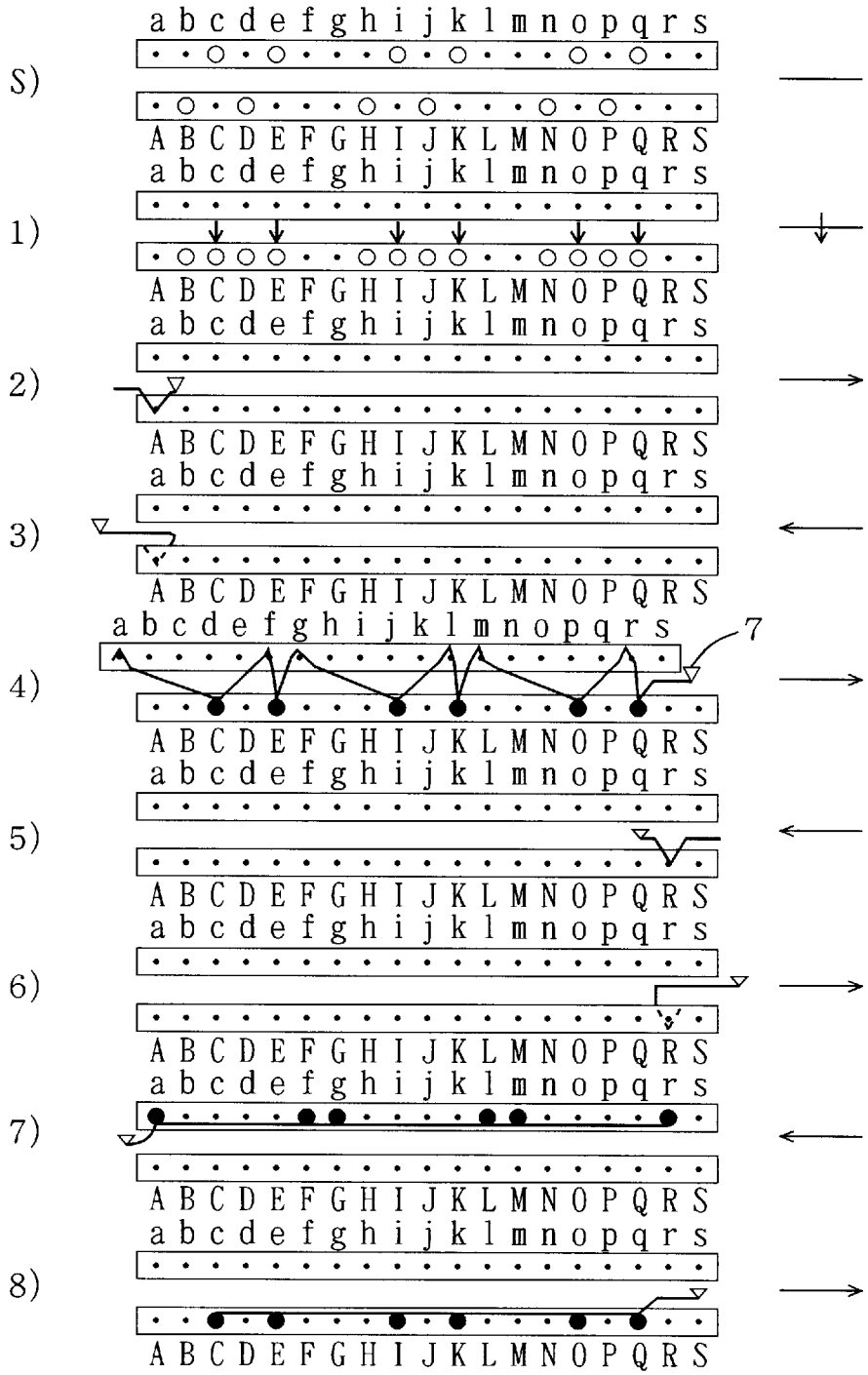
FIG. 4 shows the knitting steps of the bottom part of Embodiment 1.
Figure 5:
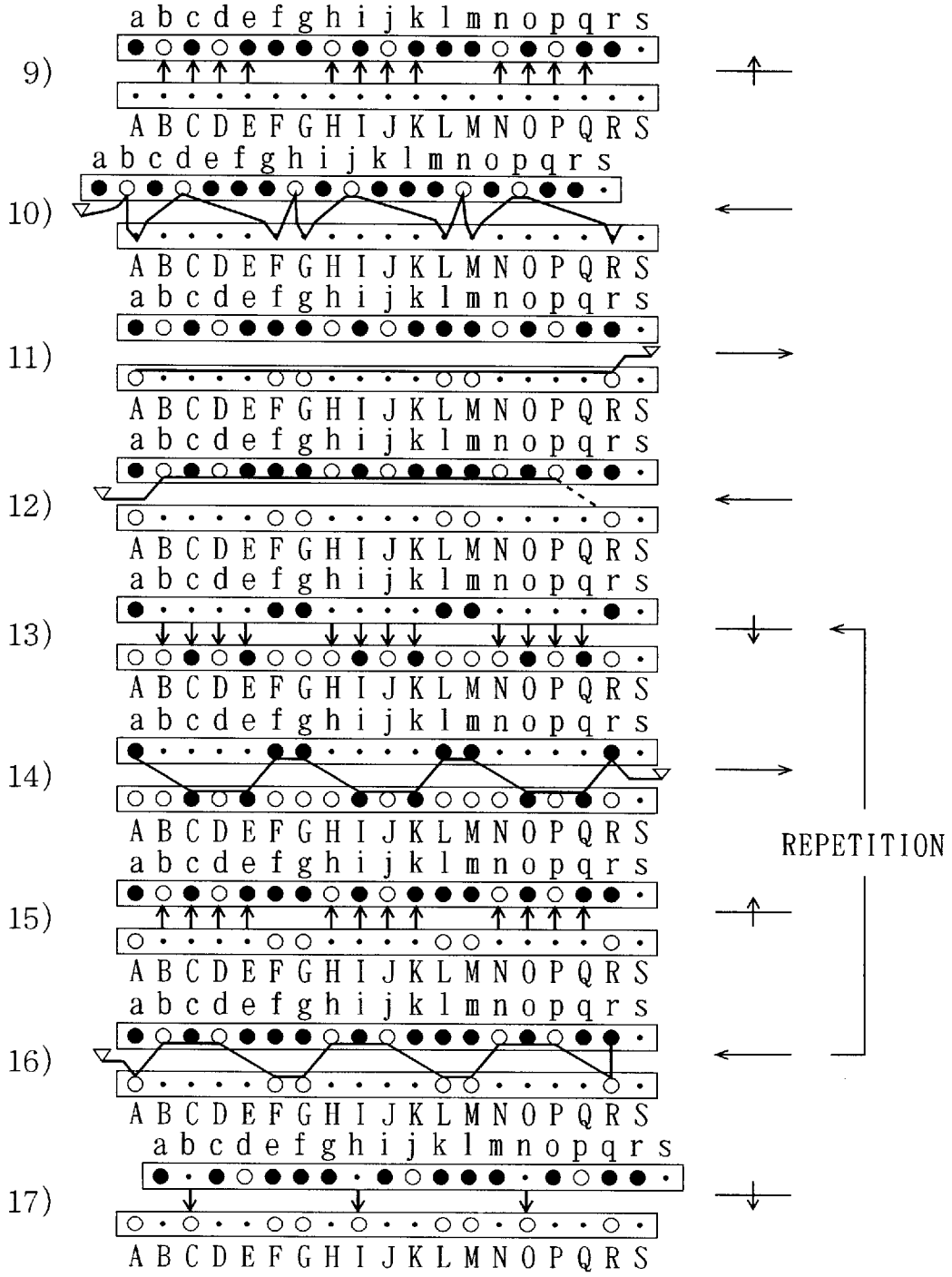
FIG. 5 shows the knitting steps of the portion subsequent to the bottom part of Embodiment 1.
Figure 6:
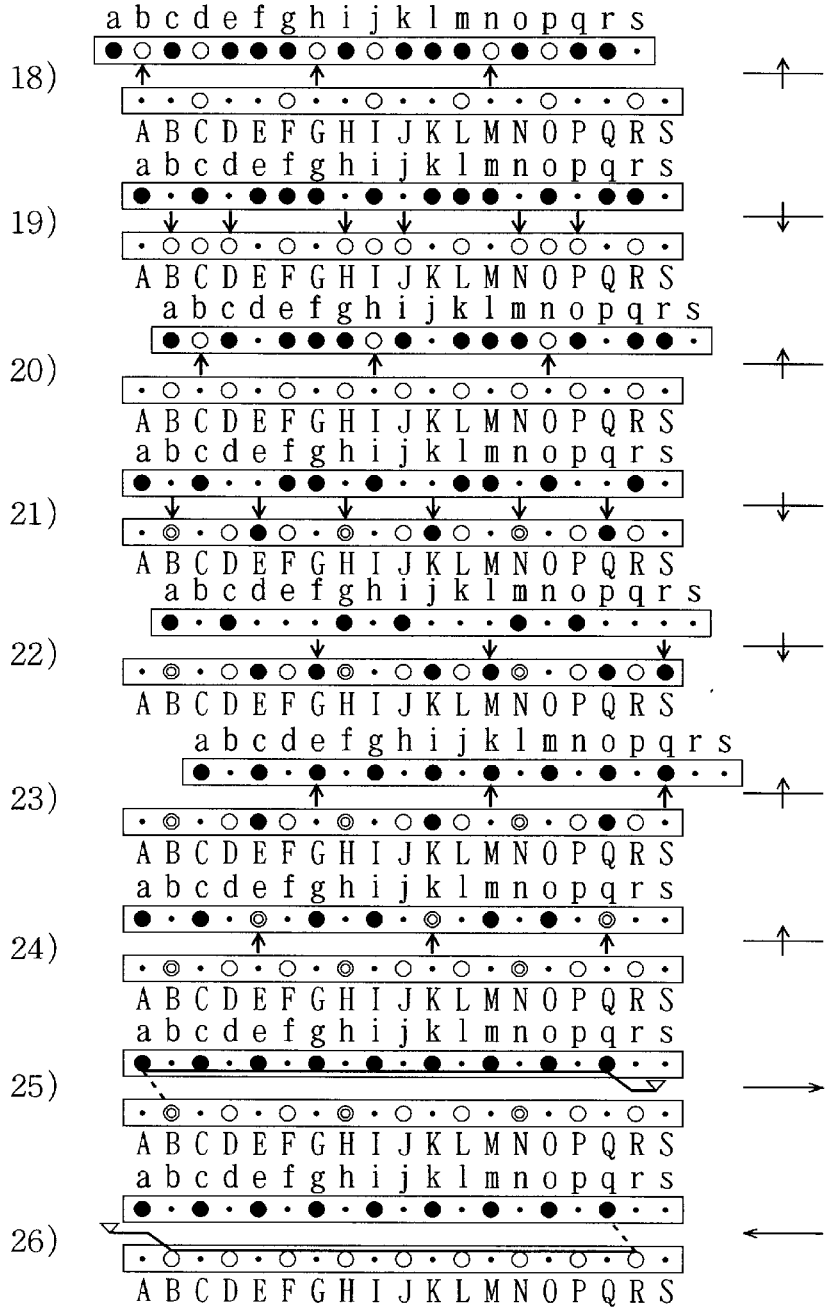
FIG. 6 shows the knitting steps of a portion further subsequent to the bottom part of Embodiment 1.

FIG. 4 through FIG. 6 show knitting steps of the bottom of the sweater 1. In the present embodiment, a single yarn feeder 7 is used, and yarn is shifted from the left towards the right to firstly form a stitch course of the back rib hem part, and subsequently yarn is shifted from the right towards the left to form a stitch course of the front rib hem part. In this way, yarn is fed by a clockwise rounding movement. On the right side of the diagram, the direction of knitting of the stitch course and the direction of transfer are indicated by arrows. The back needle bed can be racked relative to the front needle bed, and the position wherein the needles A-*a*, B-*b* . . . are directly facing with each other is defined as the standard position before racking. It should be noted that the number of needles is made smaller than the practical number for the convenience of explanation.

In the following, the respective knitting steps will be explained. Knitting of the set up part of the back rib hem part is done by steps 1 through 8. Knitting of the set up part of the front rib hem part is done by steps 9 through 12. Repetitive knitting of the front and back rib hem parts is done by steps 13 through 16. Alignment for knitting the body after knitting of the rib hem part is done by steps 17 through 23. Knitting of the body of plain stitch structure is done by steps 24 and 25. S in the diagram shows the state of holding of stitches on needle beds when draw thread knitting is completed; draw thread knitting is made at the beginning of fabric knitting. In the present case, the stitches of draw thread of the front body are held on the needles B, D, H, J, N and P of the front needle bed, and the draw threads of the back body are held on the needles c, e, i, k, o and q of the back needle bed.

In the steps 1 through 8, set up and end tubular knit of the back body 3*b*, that are subsequent to draw thread knitting, are made. In the step 1, stitches formed by draw thread of the back body 3*b* are transferred onto the needles C, E, I, K, O and Q of the front needle bed. Next, in the step 2, the yarn feeder 7 is shifted to a point beyond the needle A on the left end, and during that shift yarn is made to be hooked on the needle A. In the step 3, no stitch is formed, and only the yarn feeder 7 is shifted to the left of the needle A. The above-mentioned steps 1 through 3 are made in the standard position without racking.

The step 4 shows knitting of the set up course of the bottom of the back body, and knitting is made with the back needle bed being racked towards the left by 1.5 needles. The yarn feeder 7 is shifted to the right to feed yarn to the needles a, C, f, E, g, i, . . . of the front and back needle beds to form stitches. In the step 5, the yarn feeder 7 is shifted to a point beyond the needle R at the side end, and during that shift, yarn is hooked on the needle R, and after that, in the step 6, the yarn feeder 7 is shifted to the right of the needle R. The steps 7 and 8 show end tubular knit that is made subsequent to the knitting of the set up course. In the step 7, yarn is fed to the needles r, m, l, g, f and a to form a stitch course subsequent to the set up course. In the step 8, yarn is fed to the needles C, E, I, K, O and Q to form a stitch course.

Next, in the steps 9 through 12, set up of the front rib hem part and end tubular knit are made. First, in the step 9, back stitches of the back body 3*b* held on the needles C, E, I, K, O and Q of the front needle bed are moved onto empty needles c, e, i, k, o and q of the back needle bed; thus all the stitches of the back rib hem part are made to belong to the needles of the back needle bed. At the same time, stitches of draw thread of the back rib hem part are transferred onto the needles b, d, h, j, n and p of the back needle bed. In the step 10, knitting of the set up course of the front rib hem part is made by racking the back needle bed to the left by 1.5 needles. The yarn feeder 7 is shifted to the left to feed yarn to the needles R, p, M, n, L, j . . . of the front and back needle beds to form stitches. Stitches that were hooked in the steps 2 and 5 are joined in this process to reliably join the set up parts of the front and back rib hem parts at both side ends of the fabrics. The steps 11 and 12 show end tubular knit after set up knitting. In the step 11, yarn is fed to the needles A, F, G, L, M and R to form a stitch course subsequent to the set up course. In the step 12, yarn is fed to the needles p, n, j, h, d and b to form a stitch course. In the step 13, to make 2×1 rib stitch of the back rib hem part, the back stitches of the front rib hem part held on the needles d, b, h, h, n and p of the back needle bed are moved once onto the empty needles B, D, H, J, N and P of the front needle bed. Concurrently with this, the back stitches of the back rib hem part that were moved onto the needles c, e, i, k, o and q of the back needle bed in the step 9 are moved onto the needles C, E, I, K, O and Q of the front needle bed. In the step 14, the yarn feeder 7 is moved to the right to feed yarn to the needles a, C, E, f, g, I, . . . to knit a stitch course of 2×1 rib stitch of the back rib hem part. In the step 15, just like in the step 9, stitches are aligned for knitting the front rib hem part. In the step 16, the yarn feeder 7 is shifted to the left to feed yarn to the needles R, p, n, M, L, j . . . to knit a stitch course of 2×1 rib stitch of the front rib hem part. When the four steps of the above-mentioned steps 13 through 16 are repeated an appropriate number of times, a rib hem part of a desired length will be knitted in a tubular form. According to the knitting method of the present embodiment, formation of stitch courses and alignment can be done with the back needle bed being kept stationary in a fixed position; thus knitting can be made efficiently. When a flat knitting machine having a multi-cam system with two or more cams is used and the above-mentioned steps are assigned to the cam system, the productivity will be enhanced further.

The steps 17 through 23 show alignment of stitches for knitting the body subsequent to knitting of the rib hem part. First, in the step 17, the back needle bed is racked to the right by one needle, and the back stitches of the front rib hem part held on the needles b, h and n of the back needle bed are transferred onto the needles C, I and O of the front needle bed. In the step 18, the back needle bed is racked to the left by one needle, and the face stitches of the front rib hem part held on the needles A, G and M of the front needle bed are transferred onto the needles b, h and n of the back needle bed. After that, in the step 19, these stitches are transferred again onto the needles B, H and N of the front needle bed, and the back stitches of the front rib hem part held on the needles d, j and p of the back needle bed are transferred onto needles D, J and P. Next, in the step 20, the back needle bed is racked to the right by one needle, and the back stitches of the front rib hem part that were transferred onto the needles C, I and O of the front needle bed in the previous step 17 are transferred onto the needles b, h and n of the back needle bed. After that, in the step 21, they are transferred onto the needles B, H and N of the front needle bed. As a result, the back stitches formed on the needles b, h and n of the back needle bed are made to overlap with the face stitches of the front rib hem part that were shifted earlier onto the needles B, H and N of the front needle bed. At this point, the stitches of the front rib hem part are held on every other needle, B, D, F, H, J, . . . and the preparation for knitting of the front body 3*f* is completed.

In the step 21, the back stitches of the back rib hem part held on the needles e, k and q of the back needle bed are transferred onto the needles E, K and Q of the front needle bed. In the step 22, the back needle bed is racked to the right by one needle, and the face stitches of the back rib hem part held on the needles f, l and r of the back needle bed are transferred onto the needles G, M, S of the front needle bed. After that, in the step 23, the back needle bed is racked to the right by two needles, and the stitches are transferred again onto the needles e, k and q of the back needle bed. In the step 24, the back stitches of the back rib hem part held on the needles E, K and Q of the front needle bed are transferred onto the needles e, k and q of the back needle bed on which the face stitches of the back rib hem part are held; thus the back stitches and the face stitches are overlapped with each other. This completes the preparation for knitting the back body 3*b*.

In the steps 25 and 26, the first stitch course of the body of plain stitch that follows the rib hem part is knitted. In the step 25, the stitch course of the back body 3*b* is knitted, and in the step 26, the stitch course of the front body 3*f* is knitted.

In the present embodiment, the back stitches of the back rib hem part are formed on the third and fifth needles of the front needle bed of the unit, and the back stitches of the front rib hem part are formed on the second and fourth needles of the back needle bed. Instead of this arrangement, however, back stitches of the back rib hem part may be formed on the second and fourth needles of the front needle bed, and back stitches of the front rib hem part may be formed on the third and fifth needles of the back needle bed.

Embodiment 2

Figure 7:
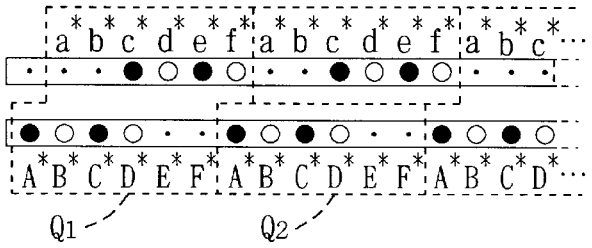
FIG. 7 shows the units of 2×1 rib stitch of Embodiment 2 of the present invention deployed on needle beds.

Another embodiment will be described. FIG. 7 corresponds to FIG. 2 of Embodiment 1 and shows the unit for 2×1 rib stitch of the present embodiment. The unit Q comprises a total of 12 needles; the first needle through the sixth needle A* through F* of the front needle bed, and the second needle through the seventh needle a* through f* of the back needle bed. 2×1 rib stitch of the front rib hem part is made with the second and fourth needles B* and D* of the front needle bed and the fifth and seventh needles d* and f* of the back needle bed. Rib stitch of the back rib hem part is made with the first and third needles A* and C* of the front needle bed and the fourth and sixth needles c* and e* of the back needle bed. The fifth needle E* of the front needle bed is the empty needle for alignment of the back stitch of the front rib hem part formed on the fifth needle d* of the back needle bed, and the sixth needle F* is the empty needle for alignment of the back stitch of the front rib hem part formed on the seventh needle f* of the back needle bed. During knitting of 2×1 rib stitch of the back rib hem part, the back stitches of the front rib hem part are moved onto these needles. Similarly, the second needle a* of the back needle bed is the empty needle for alignment of the back stitch of the back rib hem part formed on the first needle A* of the front needle bed, and the third needle b* is the empty needle for alignment of the back stitch of the back rib hem part formed on the third needle C* of the front needle bed; during knitting of 2×1 rib stitch of the front rib hem part, the back stitches of the back rib hem part are moved onto these needles. The above-mentioned unit Q is deployed on the needles A through R of the front needle bed and the needles b through s of the back needle bed to knit the rib hem part.

Figure 8:
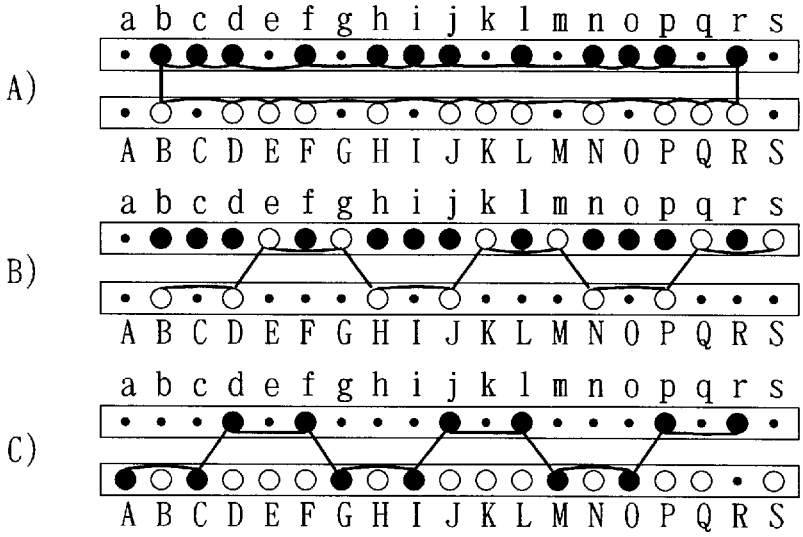
FIGS. 8(A)–(C) show how the stitches of the respective rib hem parts of the front body and the back body are held on needle beds in Embodiment 2.
Figure 9:
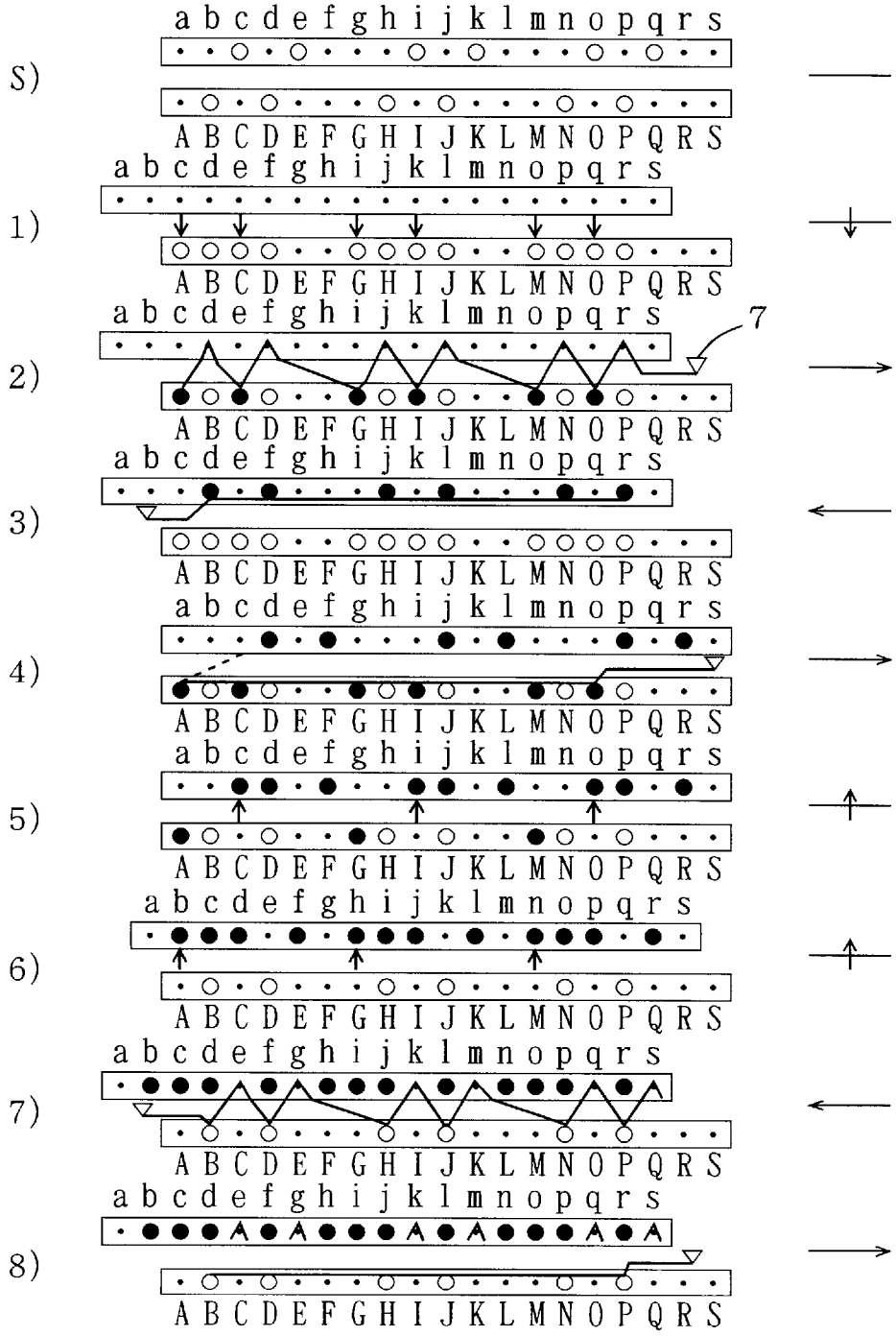
FIG. 9 shows the knitting steps of the bottom part of Embodiment 2.
Figure 10:
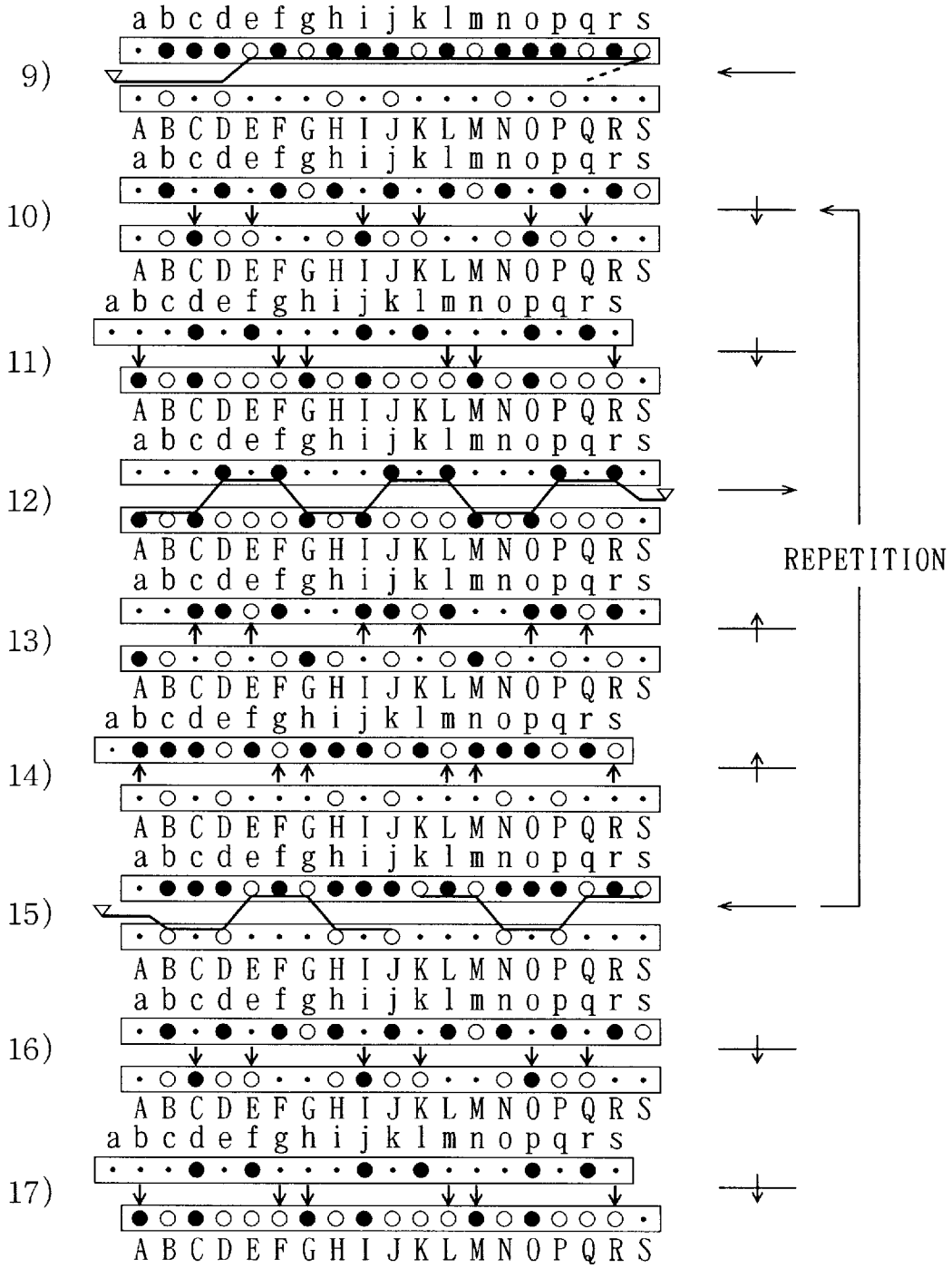
FIG. 10 shows the knitting steps of the portion subsequent to the bottom part of Embodiment 2.
Figure 11:
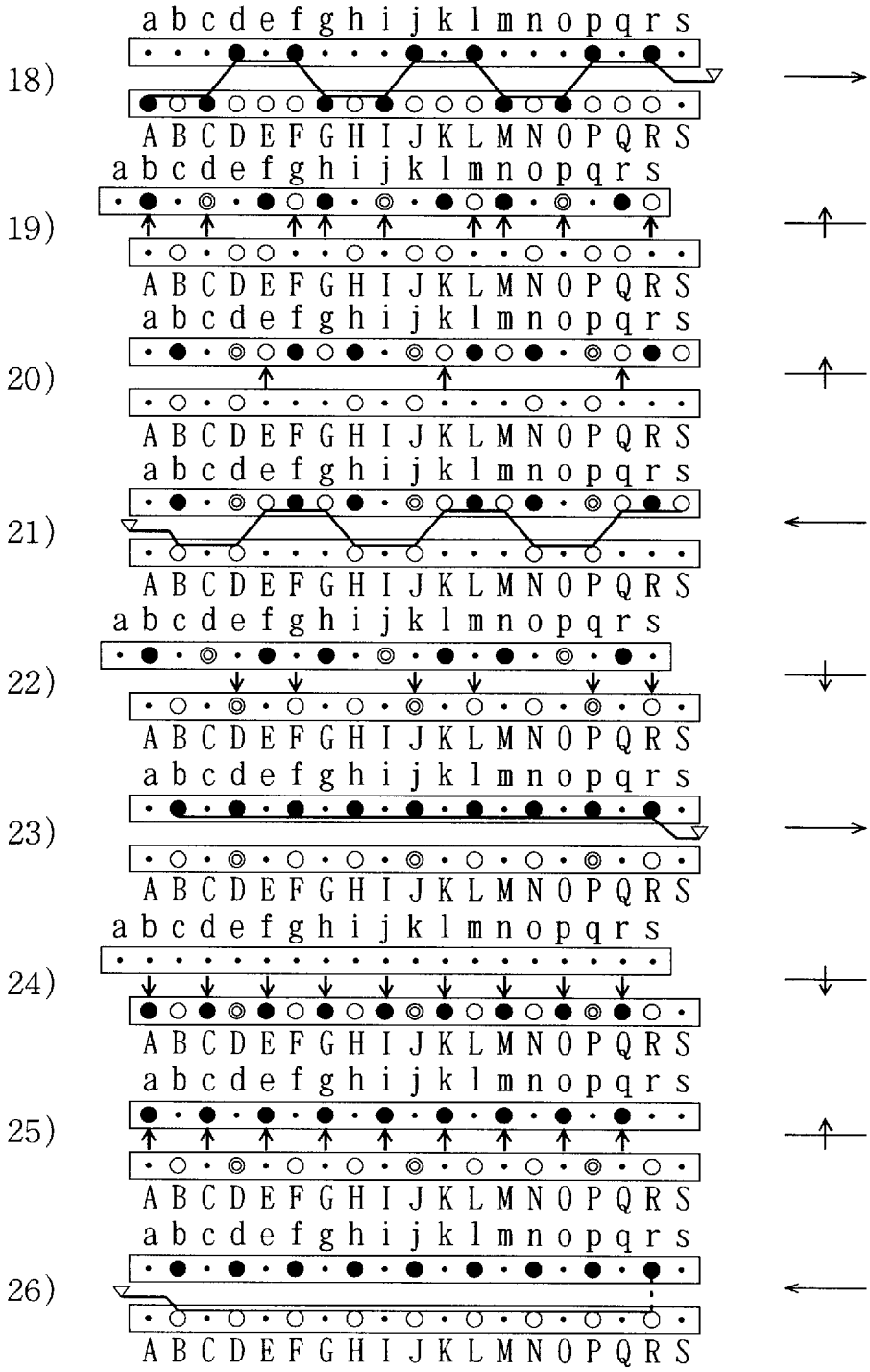
FIG. 11 shows the knitting steps of a portion further subsequent to the bottom part of Embodiment 2.

FIG. 8 corresponds to FIG. 3, and FIG. 8-A shows the state of the stitches of 2×1 rib stitch of the front rib hem part held on the needles of the front needle bed and the stitches of 2×1 rib stitch of the back rib hem part held on the needles of the back needle bed. FIG. 9 through FIG. 11 show knitting steps, and similarly with the preceding embodiment, yarn is fed circularly in a clockwise movement, in the order of the back rib hem part, the front rib hem part, the back rib hem part, . . . to knit the stitch courses of the tubular fabric.

In the following, the respective knitting steps will be described. The steps 1 through 4 are for knitting of the set up part of the back rib hem part. The steps 5 through 9 are for knitting of the set up part of the front rib hem part. In the steps 10 through 15, repetitive knitting of the front and back rib hem parts is made. The steps 16 through 26 are for alignment of stitches for knitting the body after knitting the rib hem part, and for knitting one course of the body. S in the diagram shows the state of holding of stitches on needle beds when draw thread knitting is completed. The stitches of draw thread of the front rib hem part are held on the needles B, D, H, J, N and P of the front needle bed, and the draw threads of the back rib hem part are held on the needles c, e, i, k, o and q of the back needle bed.

In the steps 1 through 4, set up and end tubular knit of the back rib hem part, that are subsequent to draw thread knitting, are made. First, in the step 1, the back needle bed is racked to the left by two needles, and stitches formed by draw thread of the back rib hem part are transferred onto the needles A, C, G, I, M and O of the front needle bed. In the step 2, with the needle bed being racked, the yarn feeder 7 is shifted to the right to feed yarn to the needles A, d, C, f, G, j, . . . of the front and back needle beds to knit the set up course of the back rib hem part. In the subsequent step 3, yarn is fed to the needles r, p, l, j, f and d. In the step 4, the back needle bed is racked to the standard position, then yarn is fed to the needles A, C, G, I, M and O to make end tubular knitting subsequent to the above-mentioned set up course.

Next, in the steps 5 through 9, set up and end tubular knitting of the front rib hem part are made. First, in the step 5, the back stitches of the back rib hem part held on the needles C, I and O of the front needle bed are moved onto the empty needles c, i and o of the back needle bed. In the next step 6, the back needle bed is racked to the left by one needle, and the back stitches of the back rib hem part held on the needles A, G and M of the front needle bed are moved onto the empty needles b, h and n of the back needle bed. In this way, all the stitches of the back rib hem part are made to belong to the needles of the back needle bed. In the step 7, with the back needle bed being racked to the left by two needles from the standard position, the yarn feeder 7 is shifted to the left to feed yarn to the needles s, P, q, N, m, J, . . . of the front and back needle beds to knit the set up course of the front rib hem part. After that, in the step 8, yarn is fed to the needles B, D, H, J, N and P, and in the next step 9, the back needle bed is racked back to the standard position and yarn is fed to the needles s, q, m, k, g and e to knit the subsequent end tubular knit course. In the present embodiment, knitting corresponding to the steps 2, 3, 5 and 6 of FIG. 3 of the preceding embodiment is omitted.

In the steps 10 and 11, to make 2×1 rib stitch of the back rib hem part, stitches are aligned. First, in the step 10, the back stitches of the front rib hem part held on the needles e, k and q of the back needle bed are moved once onto the needles E, K and Q of the front needle bed, and the back stitches of the front rib hem part that were moved onto the empty needles c, i and o of the back needle bed in the step 5 are moved onto the needles C, I and O of the front needle bed. In the next step 11, the back needle bed is racked to the left by one needle, and the back stitches of the front rib hem part held on the needles g, m and s are moved onto the needles F, L and R of the front needle bed, and the back stitches of the back rib hem part that were moved onto the empty needles b, h and n of the back needle bed in the step 6 are transferred onto the needles A, G and M of the front needle bed. In the step 12, the back needle bed is racked back to the standard position, and the yarn feeder 7 is shifted to the right to feed yarn to the needles A, C, d, f, G, I, . . . to knit a 2×1 rib stitch course of the back rib hem part. In the steps 13 and 14, stitches are aligned for subsequent knitting of the front rib hem part, and the stitches held on the needles C, E, I, K, O and Q of the front needle bed are transferred onto the needles c, e, i, k, o and q of the back needle bed, and the stitches held on the needles C, A, F, G, L, M and R of the front needle bed are transferred onto the needles b, g, h, m, n and s of the back needle bed. In the step 15, the yarn feeder 7 is shifted to the left to feed yarn to the needles s, q, P, N, m, k, . . . to knit the 2×1 rib stitch course of the front rib hem part. The six steps of the above-mentioned steps 10 through 15 are repeated for an appropriate number of times to knit the rib hem part in a tubular form.

After repetition of these steps, in the steps 16 through 21, one stitch course is formed on each of the front and back rib hem parts. In the steps 16 through 18, the stitch course of the back rib hem part is knitted and alignment of stitches and stitch formation are made, and knitting identical to that of the above-mentioned steps 10 through 12 is made. In the subsequent steps 19 and 20, alignment of stitches for knitting the stitch course of the front rib hem part is made, and to knit the body, alignment of stitches is made on the side of the back body of which rib hem part knitting is completed. In the step 19, the back needle bed is racked to the left by one needle, and the back stitches of the final course of the back rib hem part held on the needles A, C, G, I, M and O of the front needle bed are transferred onto the needles b, d, h, j, n and p of the back needle bed. As a result, the back stitches that were held on the needles C, I and O of the front needle bed are overlapped with the face stitches held on the needles d, j and p. At the same time, to knit the front rib hem part, the back stitches held on the empty needles f, l and r of the front needle bed are transferred onto the needles g, m and s of the back needle bed. In the step 20, the back needle bed is racked back to the standard position, and the back stitches of the front rib hem part held on the empty needles E, K and Q of the front needle bed are transferred onto the needles e, k and q of the back needle bed. In the step 21, the stitch course of the front rib hem part is knitted.

In the step 22, the back needle bed is racked to the left by one needle, and the back stitches of the front rib hem part held on the needles e, k and q of the back needle bed are overlapped with the face stitches held on the needles D, J and P, and the back stitches of the back rib hem part held on the needles g, m and s are transferred onto the needles F, L and R of the front needle bed. When this step is completed, the stitches of the front rib hem part are held on the needles B, D, F, H, J, . . . of the front needle bed, and the stitches of the back rib hem part are held on the needles b, d, f, h, j, . . . of the back needle bed, respectively. In the step 23, the yarn feeder 7 is shifted to the right, and yarn is fed to the above-mentioned needles of the back needle bed to knit the first stitch course of the back body 3*b*. In the subsequent steps 24 and 25, the stitches of the back body 3*b* held on the above-mentioned needles of the back needle bed are shifted to the left by one needle to hold the stitches of the back body 3*b* on the needles a, c, e, g, i, . . . As a result, the needles holding stitches of the needle beds have empty needles on the counter needle beds. In the step 26, the yarn feeder 7 is shifted to the left, and yarn is fed to the needles R, P, N, L, J, . . . of the front needle bed to knit the first stitch course of the front body 3*f*.

In this embodiment, the face stitches of the front rib hem part are formed by the second and fourth needles of the front needle bed of the unit, the back stitches of the front rib hem part are formed by the fifth and seventh needles of the back needle bed, the back stitches of the back rib hem part are formed by the first and third needles of the front needle bed, and the face stitches of the back rib hem part are formed by the fourth and sixth needles of the back needle bed. The fifth needle of the front needle bed is assigned as the empty needle for alignment of the back stitch of the front rib hem part formed on the fifth needle of the back needle bed. The sixth needle of the front needle bed is assigned as the empty needle for alignment of the back stitch of the front rib hem part formed on the seventh needle of the back needle bed. The second needle of the back needle bed is assigned as the empty needle for alignment of the back stitch of the back rib hem part formed on the first needle of the front needle bed, and the third needle of the back needle bed is assigned as the empty needle for alignment of the back stitch of the back rib hem part formed on the third needle of the front needle bed. Instead of this arrangement, however, the face stitches of the front rib hem part may be formed by the first and third needles of the front needle bed, the back stitches of the front rib hem part may be formed by the fourth and sixth needles of the back needle bed, the back stitches of the back rib hem part may be formed by the second and fourth needles of the front needle bed, and the face stitches of the back rib hem part may be formed by the fifth and seventh needles of the back needle bed, and further more, the fourth needle of the front needle bed may be assigned as the empty needle for alignment of the back stitch of the front rib hem part formed on the fourth needle of the back needle bed, the fifth needle of the front needle bed may be assigned as the empty needle for alignment of the back stitch of the front rib hem part formed on the sixth needle of the back needle bed, the third needle of the back needle bed may be assigned as the empty needle for alignment of the back stitch of the back rib hem part formed on the third needle of the front needle bed, and the fourth needle of the back needle bed may be assigned as the empty needle for alignment of the back stitch of the back rib hem part formed on the fourth needle of the front needle bed.

In the respective embodiments mentioned above, the needles A* and a* constituting the unit are located at the left end of the knitting width, and the unit is deployed three times (an integral number of times). With this arrangement, the 2×1 rib stitch pattern is continuously knitted even in the boundary between the knitting width of the front rib hem part and that of the back rib hem part without any irregularity; hence the appearance of the fabric is not affected. To keep the 2×1 rib stitch pattern intact, it is sufficient to deploy the unit in such a way that the needles A* and a* or the needles D* and d* start from the left end of the knitting width and the needles F* and f* or the needles D* and d* end at the right end of the knitting width. However, it is not absolutely necessary to deploy the unit in the above-mentioned manner. Any needles of A* and a* through F * and f* may start at the left end of the fabric, and any needles may end at the right end thereof.

In the above-mentioned case, the bottom of the sweater 1 is knitted of the 2×1 rib stitch structure. However, application of rib stitch is not limited to the bottom. The lower sleeve edges or the entire body may be knitted by rib stitch. Furthermore, the method of knitting a tubular fabric of rib stitch according to the present invention can be applied to knitting of tubular objects such as hoses and supporters, and in such cases tubular fabrics of excellent elastic property can be obtained, and the present invention may be implemented with some modification to the extent that the gist of the invention is not lost. When Embodiment 1 of FIG. 3 through FIG. 6 and Embodiment 2 of FIG. 7 through FIG. 11 are compared with each other, Embodiment 1 can be processed at a higher speed than Embodiment 2 because Embodiment 1 requires no racking for the repetitive portion. In these embodiments, a flat knitting machine having two needle beds was used. However, a flat knitting machine having four needle beds, for example, may be used.

When the above-mentioned knitting method is implemented, a tubular fabric of 2×1 rib stitch with improved elastic property, wherein a first fabric and a second fabric are joined with each other at side ends thereof, can be knitted on a flat knitting machine; this can contribute to diversification of fabric knitting by means of seamlessly knitted fabrics. According to the present invention, as the stitch density is large, tubular 2×1 rib stitch fabrics, that have high strength and excellent elastic property, can be obtained.

We claim:

1. A method of knitting a tubular fabric having a 2×1 rib stitch using a flat knitting machine having at least a first needle bed and a second needle bed, said first and second needle beds extending sidewise and abutting against each other, each of said first and second needle beds having a large number of needles, said first needle bed and said second needle bed forming a trick gap between them, and at least one of said first and second needle beds being capable of racking sidewise, and allowing stitches to be transferred between said first and second needle beds, wherein a first fabric and a second fabric are formed on the needles of the first and the second needle beds such that the first fabric and the second fabric are arranged in a front-back relationship and joined at side ends of the knitting width thereof, said method comprising the steps of:

assigning a group of 12 needles comprising a first needle through a sixth needle of each of the first and second needle beds abutting against each other as a unit of the 2×1 rib stitch of the tubular fabric;

assigning the first and sixth needles of the unit of the first needle bed as needles for forming face stitches of the first fabric;

assigning the first and sixth needles of the unit of the second needle bed as needles for forming face stitches of the second fabric;

assigning the second and fourth needles of the unit of the second needle bed as needles for forming back stitches of the first fabric;

assigning the third and fifth needles of the unit of the first needle bed as needles for forming back stitches of the second fabric;

assigning all other needles of the unit as empty needles for alignment of stitches;

first, knitting a 2×1 rib stitch course in the second fabric, wherein stitches held on the second and fourth needles of the second needle bed are transferred onto empty needles of the first needle bed, and back stitches of the second fabric held on empty needles of the second needle bed are transferred onto the third and fifth needles of the first needle bed, and after that, the first and sixth needles of the second needle bed and the third and fifth needles of the first needle bed are fed with yarn to knit the second fabric;

second, knitting a 2×1 rib stitch course in the first fabric, wherein stitches held on the third and fifth needles of the first needle bed are transferred onto empty needles of the second needle bed, and back stitches of the first fabric held on empty needles of the first needle bed are transferred onto the second and fourth needles of the second needle bed, and after that, the first and sixth needles of the first needle bed and the second and fourth needles of the second needle bed are fed with yarn to knit the first fabric; and repeating the first and second knitting steps until the tubular fabric is knitted.

2. The method of knitting a tubular fabric having a 2×1 rib stitch of claim 1 wherein, after repeating the first and second knitting steps, the stitch held by the first needle of the first needle bed and the stitch held by the second needle of the second needle bed are overlapped with each other on the second needle of one of the first needle bed and the second needle bed, and the stitch held on the sixth needle of the second needle bed and the stitch held on the fifth needle of the first needle bed are overlapped with each other on the fifth needle of one of the first needle bed and the second needle bed.

3. A method of knitting a tubular fabric having a 2×1 rib stitch using a flat knitting machine having at least a first needle bed and a second needle bed, said first and second needle beds extending sidewise and abutting against each other, said first and second needle beds having a large number of needles, said first needle bed and said second needle bed forming a trick gap between them, and at least one of said first and second needle beds being capable of racking sidewise, and allowing stitches to be transferred between said first and second needle beds, wherein a first fabric and a second fabric are formed on the needles of the first and the second needle beds, the first fabric and the second fabric being arranged in a front-back relationship and joined at side ends of a knitting width thereof, the steps of the method comprising:

assigning a group of 12 needles comprising a first needle through a sixth needle of the first needle bed and a second needle through a seventh needle of the second needle bed, such that the needles of the first needle bed and the second needle bed are shifted by one needle from each other, as a unit for knitting a 2×1 rib stitch part in the tubular fabric;

assigning the second and fourth needles of the first needle bed as needles for forming face stitches of the first fabric;

assigning the fifth and seventh needles of the second needle bed as needles for forming back stitches of the first fabric;

assigning the first and third needles of the first needle bed as needles for forming back stitches of the second fabric;

assigning the fourth and sixth needles of the second needle bed as needles for forming face stitches of the second fabric;

assigning the fifth needle of the first needle bed as an empty needle for alignment of the back stitch of the first fabric that is formed on the fifth needle of the second needle bed;

assigning the sixth needle of the first needle bed as an empty needle for alignment of the back stitch of the first fabric that is formed on the seventh needle of the second needle bed;

assigning the second needle of the second needle bed as an empty needle for alignment of the back stitch of the second fabric that is formed on the first needle of the first needle bed;

assigning the third needle of the second needle bed as an empty needle for alignment of the back stitch of the second fabric that is formed on the third needle of the first needle bed;

first, knitting a 2×1 rib stitch course in the second fabric, wherein back stitches of the first fabric held on the needles of the second needle bed are transferred onto empty needles of the first needle bed, and back stitches of the second fabric held on empty needles of the second needle bed are transferred onto needles of the first needle bed, and after that, needles holding the second fabric of the first needle bed and of the second needle bed are fed with yarn to knit the second fabric;

second, knitting a 2×1 rib stitch course in the first fabric, wherein back stitches of the second fabric held on the needles of the first needle bed are transferred onto empty needles of the second needle bed, and back stitches of the first fabric held on empty needles of the first needle bed are transferred onto needles of the second needle bed, and after that, the needles of the first needle bed and of the second needle bed holding the first fabric are fed with yarn to knit the first fabric; and repeating the first and second knitting steps until the tubular fabric is knitted.

* * * * *